United States Patent [19]

Beltran

[11] Patent Number: 4,616,790

[45] Date of Patent: Oct. 14, 1986

[54] EXCESS TUBING RETAINER FOR A FLUID OR GAS DELIVERY SYSTEM

[76] Inventor: Delfin J. Beltran, 30 Zapata Way, Portola Valley, Calif. 94025

[21] Appl. No.: 634,603

[22] Filed: Jul. 26, 1984

[51] Int. Cl.[4] ..... B65H 75/28

[52] U.S. Cl. ..... 242/85.1; 242/129

[58] Field of Search ..... 242/85.1, 86, 125.1, 242/129, 96; 604/93; 24/71.2, 71.3

[56] References Cited

U.S. PATENT DOCUMENTS

| | | | |
|---|---|---|---|
| 912,796 | 2/1909 | Boye | 242/129 X |
| 1,408,261 | 2/1922 | Brookhart | 242/85.1 |
| 1,910,597 | 5/1933 | Elliott | 242/85.1 |
| 2,023,526 | 12/1935 | Hoberg | 242/85.1 |
| 2,137,618 | 11/1938 | Krimmel | 242/129 X |
| 2,422,358 | 6/1947 | Lobl | 242/85.1 |
| 2,665,805 | 1/1954 | Schaefer | 242/85.1 X |
| 2,683,937 | 7/1954 | Criswell | 24/71.3 X |
| 2,936,963 | 5/1960 | Witte | 242/85.1 |

*Primary Examiner*—Stuart S. Levy
*Assistant Examiner*—David Werner
*Attorney, Agent, or Firm*—Fliesler, Dubb, Meyer and Lovejoy

[57] ABSTRACT

A tubing retainer for use in fluid or gas delivery system for releasably retaining excess tubing in the system. A member is provided for receiving coils of the excess tubing and a hole and slot arrangement are provided for releasably receiving opposite ends of the excess tubing. The coil receiving member is provided to restrict the minimum diameter of the coils so as to avoid the creation of tube occluding type kinks in the tubing.

12 Claims, 5 Drawing Figures

EXCESS TUBING RETAINER FOR A FLUID OR GAS DELIVERY SYSTEM

FIELD OF THE INVENTION

The present invention is related to fluid and gas delivery systems used in providing medical treatment in general and to an apparatus for releasably retaining excess tubing between a source of fluid or gas attached to one end of the tubing and a catheter, diagnostic apparatus or other apparatus attached to the opposite end thereof.

BACKGROUND OF THE INVENTION

Current patient care techniques frequently require the continuous administration to a patient of fluids containing medications, nutrients, blood components, or the like from sources which are removed some distance from the patient. Similarly, current procedures frequently require the administration of gases to and the sampling of gases from a patient which are analyzed for their physical characteristics by equipment located at a distance from the patient.

In most, if not all, cases, the fluid and gases are delivered to and/or from a patient by means of hollow flexible conduit or tubing.

In a typical intravenous (IV) fluid delivery system, for example, there is provided a source bottle or flexible bag containing a fluid substance which is to be delivered to the patient. The source is suspended above the patient from a stand or the like. Attached to the outlet of the source there is provided a length of tubing, sometimes called an IV line. The opposite end of the tubing is fitted with or otherwise connected to a catheter or other apparatus which is inserted in a patient.

In certain circumstances, such as in cases requiring acute, intensive or emergency care, a number of sources of fluids may be connected to the same catheter. In such cases, the individual tubes or IV lines which are connected to each of the sources are joined to a single IV line connected to the catheter or other insertion device by means of a manifold. Alternatively, a number of sources of fluids maybe connected by individual IV lines to separate catheters or other insertion devices for delivering each of the fluids at different locations in a patient simultaneously. For example, an average heart patient in a intensive care unit typically uses from three to six IV fluid sources at a time and sometimes more.

In addition to the fluid sources and tubing, an IV system may also include pressure and flow controllers, filters and other components which are interconnected by IV tubing.

The ends of the tubing which is used to interconnect the various components of a typical IV fluid delivery system are usually provided with fittings for connecting the tubing to the other components in the system. Typically, the tubing with its fittings comes in predetermined lengths. The lengths are not selectable in accordance with an individual patient application, but, are standard lengths which are determined by individual tubing and medical equipment suppliers which supply the tubing. Thus, depending on the location and arrangement of the IV fluid sources and the number and arrangement of the other component parts in the IV system, there maybe, and frequently there is as a result of the standardization practices of individual tubing supplies, an excess of IV tubing interconnecting the component parts which must be accommodated.

In the case of equipment used to sample and analyze gases, such as respiratory gases, for example, equipment requirements frequently determine the length of tubing used for delivering the gases from the patient to the equipment. As in the case of conventional IV fluid delivery systems, such equipment requirements frequently result in excess tubing between the patient and the equipment which must be accommodate.

Presently, it is the practice to freely manually coil the excess IV and gas tubing and use tape, such as adhesive tape or the like, to retain the coils. This practice has been found to create a number of problems. For example, one of the problems is that the manual uncontrolled coiling of the tubing often results in coils having too small a diameter relative to the diameter of the tubing. As a consequence, the tubing may be kinked thus partially or totally occluding the tubing and impairing fluid and/or gas flow to and/or from the patient which may not be immediately noted by attending medical personnel.

Other problems result from the use of tape to retain the coils. For example, when it becomes necessary to shorten or lengthen an IV or gas line, to remove or add a component from or to an IV or gas line or to trace an IV or gas line from an external apparatus to the point of insertion in a patient to verify the line in which fluid or gas flow is to be adjusted or a change in fluid or gas is to be made, it is often necessary to remove the tape, do what is required and thereafter reapply the tape. The amount of tape used can be, and often is, excessive and its removal and reapplication can require the use of two hands and result in inordinate delays.

As discussed above, in acute, intensive or emergency care cases multiple conduits or lengths of tubing may coexist in the same environment. In these cases, rapid recognition of each conduits role and isolation of the conduit or its extremities can be essential to successful life support.

For these reasons the present practice and procedure of using tape to retain the coils is time consuming and troublesome and, in the case of an emergency when it is necessary to make immediate adjustments to the IV or gas system, it can be potentially detrimental to the patient.

In addition to the aforementioned problems resulting from the present practice of freely coiling excess IV or gas tubing and using tape to retain the coils in present IV or gas systems, there is further no provision in present IV or gas systems for identifying the fluid or gas flowing in a particular line by means other than tracing the line to the fluid or gas source.

SUMMARY OF THE INVENTION

In view of the foregoing, a principal object of the present invention is a fluid or gas delivery system tubing retainer for retaining excess tubing in the system.

In accordance with the above object, a principal feature of the present invention is a retainer for retaining excess tubing in an IV fluid or gas delivery system about which the excess tubing is releasably coiled and which includes means for restricting the minimum diameter of the coils retained thereon to thereby prevent kinking of the tubing which would otherwise impact or disrupt fluid or gas flow in the tubing.

Another feature of the present invention is an excess tubing retaining means as described above with means for releasably capturing the upstream and downstream ends of the excess tubing in the retainer.

Another feature of the present invention is an excess tubing retaining means as described above with means for receiving identifying indicia which may be used for identifying such things as the type of fluid or gas source connected to the tubing, the time the fluid or gas flow in the tubing was started, the time system changes should be made, and the like.

In one embodiment of the invention, the indicia receiving means comprises a surface to which an identifying label is removably attached. In another embodiment of the invention the receiving means comprises a surface on which desired information is written directly and maybe removed therefrom. In still another embodiment of the invention, the excess tubing retaining means is color coded for particular usages.

In one embodiment of the present invention, there is provided a relatively thin disk of plastic or other suitable material comprising a plurality of cantilevered petals. The petals extend from a hinge portion in the interior of the disk toward the periphery of the disk. Between the periphery of the petals and the periphery of the disk there is provided a hole. Extending from the hole, there is provided a narrow slot. Typically, the hole has a diameter which is from 2 to 2.5 times the diameter of the tubing used therewith. The slot has a width which is less than the diameter of the tubing used therewith.

In use, excess IV or gas tubing is coiled about the bases of the petals and resiliently captured between the petals and the disk. The ends of the excess tubing are forced through the slot into the hole and releasably captured therein. The surface of the disk between the bases of the petals is used for receiving an identifying label. The label may contain such information as the type of fluid or gas flowing in the line, the time system changes are required to be made, and the like. If a label is not used, the user may write directly on the surface. As an additional feature, the disk may be color coded.

In another embodiment of the invention, a solid reel or drum is used instead of the above described petals for receiving the coils of the excess tubing.

In general, each of the above described embodiments of the invention permit the quick addition and removal of coils of excess tubing to and therefrom, avoid kinking of the tubing, and may be used with identifying indicia.

BRIEF DESCRIPTION OF THE DRAWING

The above and other objects, features and advantages of the present invention will become apparent from the following detailed description of the accompanying drawing in which.

DETAILED DESCRIPTION OF THE INVENTION

Figure 1:
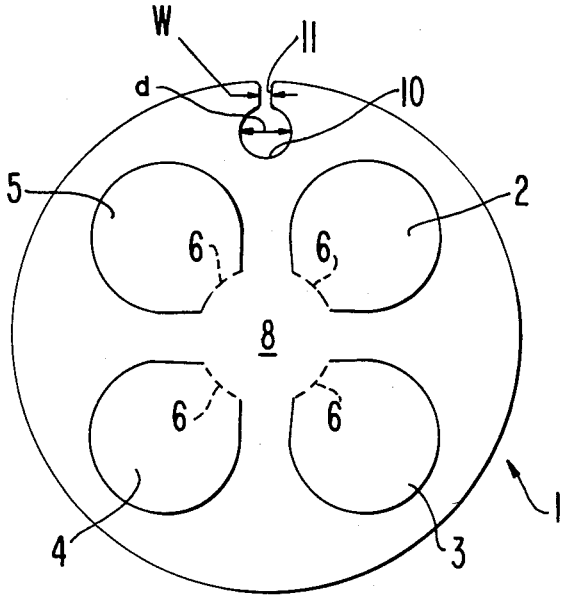
FIG. 1 is an elevation view of an embodiment of a retainer according to the present invention.
Figure 2:
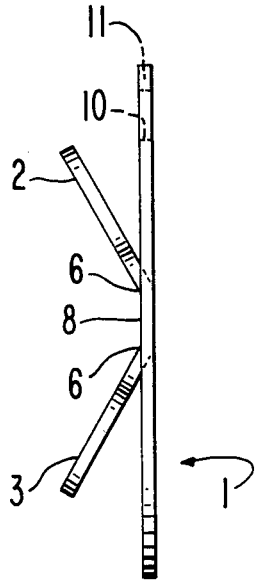
FIG. 2 is a side view of FIG. 1.

Referring to FIGS. 1 and 2, there is provided in one embodiment of the present invention an excess tubing retaining member comprising a disk member designated generally as 1. In the disk member 1, there is provided a plurality of petal members 2,3,4, and 5. Each of the petal members 2–5 is attached to the disk member 1 at a base portion 6 and extends outwardly from the base portion 6 toward the periphery of the disk member 1. In practice, the base portion 6 comprises a flexible resilient hinge member which may be an integral part of the disk member 1 and petals 2–5 or it may be a separate hinge member (not shown) which is used for attaching the petals 2–5 to the disk member 1. In either case, the hinge member resiliently forces the petal members 2–5 toward the disk member 1.

Between the periphery of the petals 2–5 and the periphery of the disk member 1, there is provided a hole 10. The hole 10 has a predetermined diameter d which is typically from 2 to 2.5 times the diameter of the tubing used therewith.

Extending from the hole 10 to the periphery of the disk member 1, there is provided a slot 11. The slot 11 has a width w which is less than the diameter of the tubing used therewith, e.g. 0.5 times the diameter of the tubing.

Between the bases 6 of the petals 2–5, there is provided a surface 8 on the disk member 10 to which there may be affixed a label or other indicia bearing member, not shown. The label may contain, for example, information as to the nature or type of fluid or gas flowing in the tubing, the time that system changes must be made and the like. Alternatively, the surface 8 may be prepared in any suitable manner for writing thereon directly. Any such writing should be easily removable and suitable materials for that purpose are well known.

Figure 3:
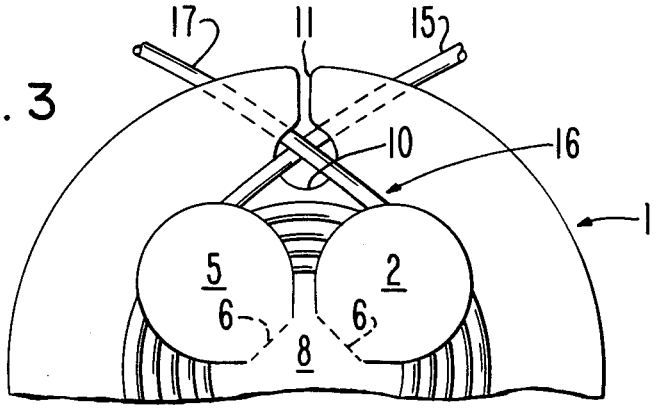
FIG. 3 is an enlarged view of the upper portion of the retainer of FIG. 1 showing excess tubing coiled on an releasably captured in the retainer.

Referring to FIG. 3, in use, one end 15 of excess IV or gas tubing 16 is forced through the slot 11 and into the hole 10. Thereafter, the remaining excess tubing is coiled about the bases of the petals 2–5 and resiliently captured between the petals 2–5 and the surface of the disk member 1. After a desired amount of excess tubing has been coiled about the bases of the petals 2–5, an opposite end 17 of the excess tubing 16 is forced through the slot 11 into the hole 10. Because of the resilient nature of the tubing, the ends 15 and 17 of the tubing will be captured within the hole 10 until forcibly removed therefrom. When it is necessary to shorten or lengthen the tubing, it is a simple matter to remove the end 17 from the hole 10 and add or remove a desired number of coils and return the end 17 to the hole 10.

Figure 4:
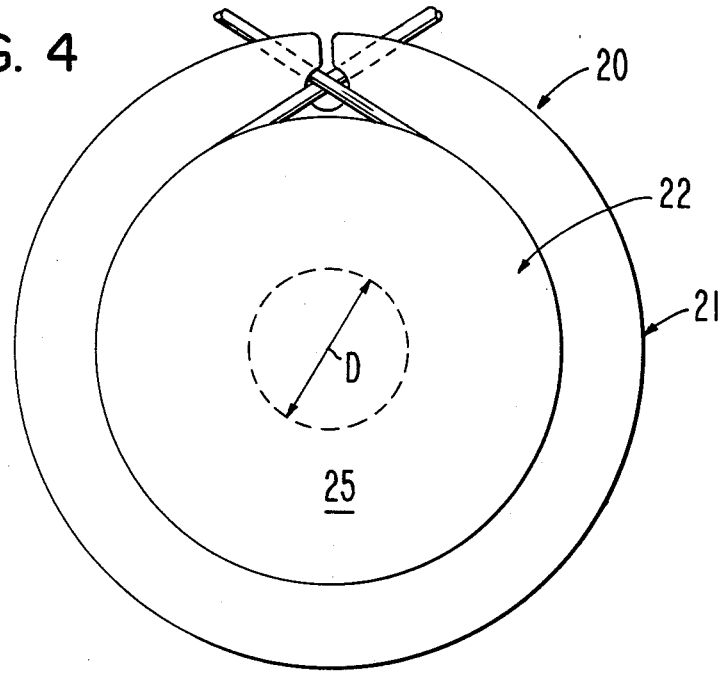
FIG. 4 is an elevation view of another embodiment of a retainer according to the present invention.
Figure 5:
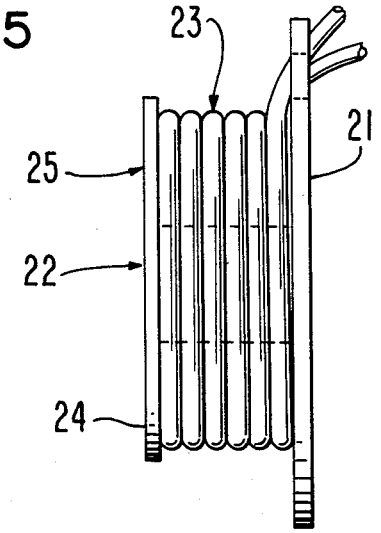
FIG. 5 is a side view of FIG. 4.

Referring to FIGS. 4 and 5, there is provided in another embodiment of the invention, a reel-type tubing retaining member designated generally as 20. In the member 20, there is provided a disk member 21. Extending outwardly from the center of the member 21 in a cantilevered fashion, there is provided a drum or reel member 22 having a diameter D. The diameter D is sufficient to prevent kinking of tubing 23 coiled thereabout. Extending outwardly and perpendicularly from the free end of the member 22, there is provided a coil retaining flange 24. Located between the periphery of the member 22 and the periphery of the disk member 21, there is provided a hole 10 and a slot 11 which are identical in size and shape and used in the same manner as the hole 10 and slot 11 described above with respect to FIGS. 1–3.

Located on the exterior of the member 22, there is provided a surface 25. Surface 25 is provided for receiving a label or written information directly in the same manner as the surface 8 described above with respect to the embodiment of FIGS. 1–3.

In addition to the surfaces 8 and 25, each of the embodiments of the invention described above may be color coded to assist in representing particular predetermined usages of the devices.

While preferred embodiments of the invention are described, it is contemplated that various modifications maybe made thereto without departing from the spirit and scope of the invention. Accordingly, the embodiments described are provided only for purposes of illustration and the spirit and scope of the invention should not be limited thereto, but, rather be determined by the claims hereinafter provided.

What is claimed is:

1. For use in fluid and gas delivery systems shaving an excess of flexible, hollow tubing between an input end of said tubing coupled to a source of fluids or gases and an output end of said tubing coupled to a receiver of fluids or gases, an excess tubing retaining apparatus comprising:

a disk-shaped member having an outer periphery and means extending from an interior surface of said disk-shaped member for supporting coils of said excess tubing;

a hole located in said disk-shaped member comprising a predetermined diameter; and a slot which extends from said hole to said outer periphery of said disk-shaped member, said slot having a width which is less than half said predetermined diameter of said hole for releasably retaining in a substantially nonoccluding manner a first segment of said tubing located between said coils and said input end and a second segment of said tubing located between said coils and said output end such that said first and said second segments cross in the vicinity of said hole at a point located between said coils and said input and said output ends, respectively.

2. An apparatus according to claim 1 wherein said coil supporting means comprises a cylindrical member which extends generally perpendicularly from said interior surface of said disk-shaped member in a cantilevered fashion and has an annular coil retaining flange extending perpendicularly from the free end thereof.

3. An apparatus according to claim 1 wherein said coil supported means comprises:

a plurality of equidistantly spaced resilient petal-shaped members which extend from said interior surface of said disk-shaped member in a cantilevered fashion toward said periphery of said disk-shaped member for resiliently supporting said coils of said tubing between a surface of each of said petal-shaped members and a surface of said disk-shaped member.

4. An apparatus according to claim 3 wherein said disk-shaped member comprises a center, each of said petal-shaped members comprises a base portion and said base portions of all of said petal-shaped members are located a predetermined distance from said center of said disk-shaped member for restricting the minimum diameter of said coils to thereby prevent an occlusion of said tubing.

5. An apparatus according to claim 4 wherein said disk-shaped member comprises a surface which extends from said center of said disk-shaped member to said base portions of all of said petal-shaped members on which information may be placed by a user of said apparatus.

6. An apparatus according to claim 4 wherein said apparatus is color-coded.

7. An apparatus according to claim 2 wherein said cylindrical member comprises a surface on said free end thereof on which information may be placed by a user of said apparatus.

8. An apparatus according to claim 7 wherein said surface comprises a surface to which a label containing information may be affixed.

9. An apparatus according to claim 7 wherein said surface comprises a surface on which information can be directly written or printed by a user thereof.

10. An apparatus according to claim 2 wherein said apparatus is color-coded.

11. An apparatus according to claim 5 wherein said surface comprises a surface to which a label containing information may be affixed.

12. An apparatus according to claim 5 wherein said surface comprises a surface on which information can be directly written or printed by a user thereof.

* * * * *

UNITED STATES PATENT AND TRADEMARK OFFICE

CERTIFICATE OF CORRECTION

PATENT NO. : 4,616,790

DATED : October 14, 1986

INVENTOR(S) : DELFIN J. BELTRAN

It is certified that error appears in the above-identified patent and that said Letters Patent is hereby corrected as shown below:

Column 3, line 58, "an" should be --and--.

Column 5, line 14, "shaving" should be --having--.

Column 6, line 2, "supported" should be --supporting--.

Signed and Sealed this

Thirteenth Day of January, 1987

*Attest:*

DONALD J. QUIGG

*Attesting Officer*

*Commissioner of Patents and Trademarks*